United States Patent [19]

Alderman

[11] 4,047,345

[45] Sept. 13, 1977

[54] ROOF SYSTEM

[76] Inventor: Robert J. Alderman, 812 59th St., N.W., Bradenton, Fla. 33505

[21] Appl. No.: 638,329

[22] Filed: Dec. 8, 1975

Related U.S. Application Data

[63] Continuation-in-part of Ser. No. 494,097, Aug. 2, 1974, Pat. No. 3,969,863.

[51] Int. Cl.[2] ..... E04B 2/28; E04B 2/60; E04F 21/00

[52] U.S. Cl. ..... 52/404; 52/407; 52/483; 52/743; 52/748

[58] Field of Search ..... 52/90, 393, 394, 403, 52/402, 404, 407, 321, 326, 483, 488, 665, 667, 743, 748

[56] References Cited

U.S. PATENT DOCUMENTS

| | | | |
|---|---|---|---|
| 1,414,332 | 4/1922 | Hartmann | 52/407 |
| 2,007,374 | 7/1935 | Kuehne | 52/407 X |
| 2,287,400 | 6/1942 | Wells, Jr. | 52/407 X |
| 3,092,221 | 6/1963 | Parsons et al. | 52/665 X |
| 3,513,614 | 5/1970 | Studzinski | 52/743 |
| 3,559,914 | 2/1971 | Alderman | 242/86.52 |

FOREIGN PATENT DOCUMENTS

| | | | |
|---|---|---|---|
| 1,028,906 | 5/1966 | United Kingdom | 52/90 |
| 672,297 | 5/1952 | United Kingdom | 52/478 |

*Primary Examiner*—Alfred C. Perham

[57] ABSTRACT

A roof structure is fabricated by supporting a lattice of support straps through openings in the purlins, supporting one or more reels of insulation material on adjacent pairs of purlins with the width of the material spanning the space between the purlins, moving the reels along the lengths of the purlins and paying out the insulation material from the reels down into the spaces between the purlins and onto the lattice of support straps to substantially fill the space above the straps to the tops of the purlins. Additional insulation material is applied to the upper surfaces of the purlins. The workmen follow the reels of insulation material and connect the hard roofing material over the insulation material to the purlins to complete the roof structure.

12 Claims, 3 Drawing Figures

ROOF SYSTEM

CROSS-REFERENCE TO RELATED APPLICATION

This application is a continuation-in-part of my prior U.S. application Ser. No. 494,097, filed Aug. 2, 1974, now U.S. Pat. No. 3,969,863, issued July 20, 1976.

BACKGROUND OF THE INVENTION

Roof structures of industrial buildings typically comprise roof or rafter beams which extend parallel to one another across the building in one direction and purlins mounted on the rafters which extend parallel to one another in directions normal to the rafters. Insulation material is spread in long sheets or strips over the purlins with the lengths of the sheets extending normal to the lengths of the purlins, and hard roofing material is attached to the purlins through the insulating material. In the past, roof structures of this type have been difficult to assemble, and since the seams of abutting sheets of insulating material are usually exposed to the inside of the building structure, any gaps appearing in the seams are exposed within the building structure and air within the building contacts the hard roofing material, resulting in heat transfer and vapor condensation.

The typical construction process for a roof structure includes the steps of unreeling sheets of insulation material from large reels of insulation material and placing the sheets of material with their lengths extending across the lengths of the purlins. The sheets of insulation material are stretched to prevent sagging between the purlins, and the hard roofing material is then placed over the insulation material and connected to the purlins. The hard roofing material is used as the working surface for the workmen and the reels of insulation material are unwound on this working surface and then moved by hand over to the exposed purlins adjacent the hard roofing material. With this procedure, poor alignment of the sheets of insulation material is likely to occur and gaps between adjacent sheets of insulation material are likely to be formed.

Because of the likelihood of gaps occurring between the adjacent sheets of insulation material, some manufacturers have produced insulation material with tapes that overhang the edges of the insulation material and which would normally overlap an adjacent sheet of insulation material in the roof structure. Also, rolls of tape, glue, and other devices have been developed for connecting together the abutting edges of insulation material in a roof structure to prevent gaps from appearing between adjacent strips of material. However, it is expensive and onerous for the workmen to seal the gaps with the use of these devices. Furthermore, since the strips of insulation material must be stretched to prevent sagging between the purlins, the workmen usually extend the strips of insulation material beyond the edges of the building structure so as to leave enough material available for the workmen to pull on for the purpose of stretching the material. After the strips of insulation material have been stretched, the overhanging edge portions must be cut away and discarded as waste.

As the typical roof structure is formed, it is customary to form the entire width of the roof structure at one time, proceeding along the length of the structure from one end to the other. This method of construction has been desirable since the insulation material comes in strips or long sheets and it has been convenient for the workmen to place the long sheets across the lengths of the purlins and immediately place the hard roofing material over the insulation material in their progression along the lengths of the purlins; however, the workmen are required to move back and forth across the width of the building and carry and retrieve their various manual and electrically actuated tools with them. Furthermore, the long lengths of insulation material are difficult to handle as it is being unreeled from its reels and moved onto the purlins from the surface of the hard roofing material. While the long sheets of insulation material are difficult to handle on a still day, they are extremely difficult and dangerous to handle on a windy day—so much so that it is virtually impossible to handle the material. Of course, the wind factor also affects the neatness of the job, the number of gaps in the seams of the insulation material, the warping or stretching of the material, the number of workmen required to lay the material, and the safety of the workmen.

As set forth in U.S. Pat. No. 3,559,914, I have developed an improved roof structure and a system for applying insulation to the structure wherein the reels of insulation material are supported by adjacent ones of the purlins and the insulation material is paid out from the reels along the purlins instead of across the purlins. The width of the insulation material spans the spaces between adjacent ones of the purlins and the edges of the strips of material extend along the upper surfaces of the purlins and are hidden from view. Support frames are provided for holding the reels of insulation material on the purlins and the support frames are pushed along the length of the purlins progressively across the roof structure as the sheets of hard roofing material are applied to the roof structure.

While my patented system has met with substantial commercial success, there is also a need for heavily insulated roof structures in colder climates. When the thickness of the insulation material between the purlins and the hard roofing surface is increased, the hard roofing material tends to "work" with respect to the purlins and insulation material as the hard roofing material expands and contracts due to increases and decreases in its temperature and as it moves in response to wind forces. Moreover, as the thickness of the insulation material between the purlins and the hard roofing surface increases, it is more difficult to place and hold the insulation material on the purlins and to attach the hard roofing surface to the purlins through the thicker insulation material.

SUMMARY OF THE INVENTION

Briefly described, the present invention comprises a roof system in which purlins resting on rafters define openings through their upwardly extending central webs, a lattice of support straps extends through openings of the webs of the purlins, thick insulation material is placed on the lattice of support straps between the purlins, and the hard roofing material is attached to the purlins over the insulation material. The openings in the purlins which accommodate the support straps are located at varying heights so the lattice of support straps can be located at variable distances from the hard roofing material to receive insulation material of different thicknesses. In addition, thin narrow strips of insulation material are applied to the upper surfaces of the purlins, between the purlins and the hard roofing material, to minimize the transfer of heat from the hard roofing material to the purlins. The insulation material is applied to the roof structure by mounting reels of insulation material on support frames and moving the support frames along the length of the purlins and unreeling or paying out the insulation material from the reels as the frames are moved. One or more layers of insulation material can be applied to the support lattice between the purlins, as may be desired. The lower flanges of the purlins in the final roof structure protrude downwardly from the insulation material and are available for supporting electrical conduits, plumbing, and other items usually without requiring displacement of the insulation material.

Thus, it is an object of the present invention to provide a roof structure that is attractive, inexpensive to construct, useful, and which provides good insulation from heat and cold.

Another object of this invention is to provide an improved method of applying a roof structure to an industrial building, or the like, wherein the structure is expediently, safely, accurately and inexpensively formed.

Other objects, features and advantages of the present invention will become apparent upon reading the following specification, when taken in conjunction with the accompanying drawing.

DESCRIPTION OF AN EMBODIMENT

Figure 1:
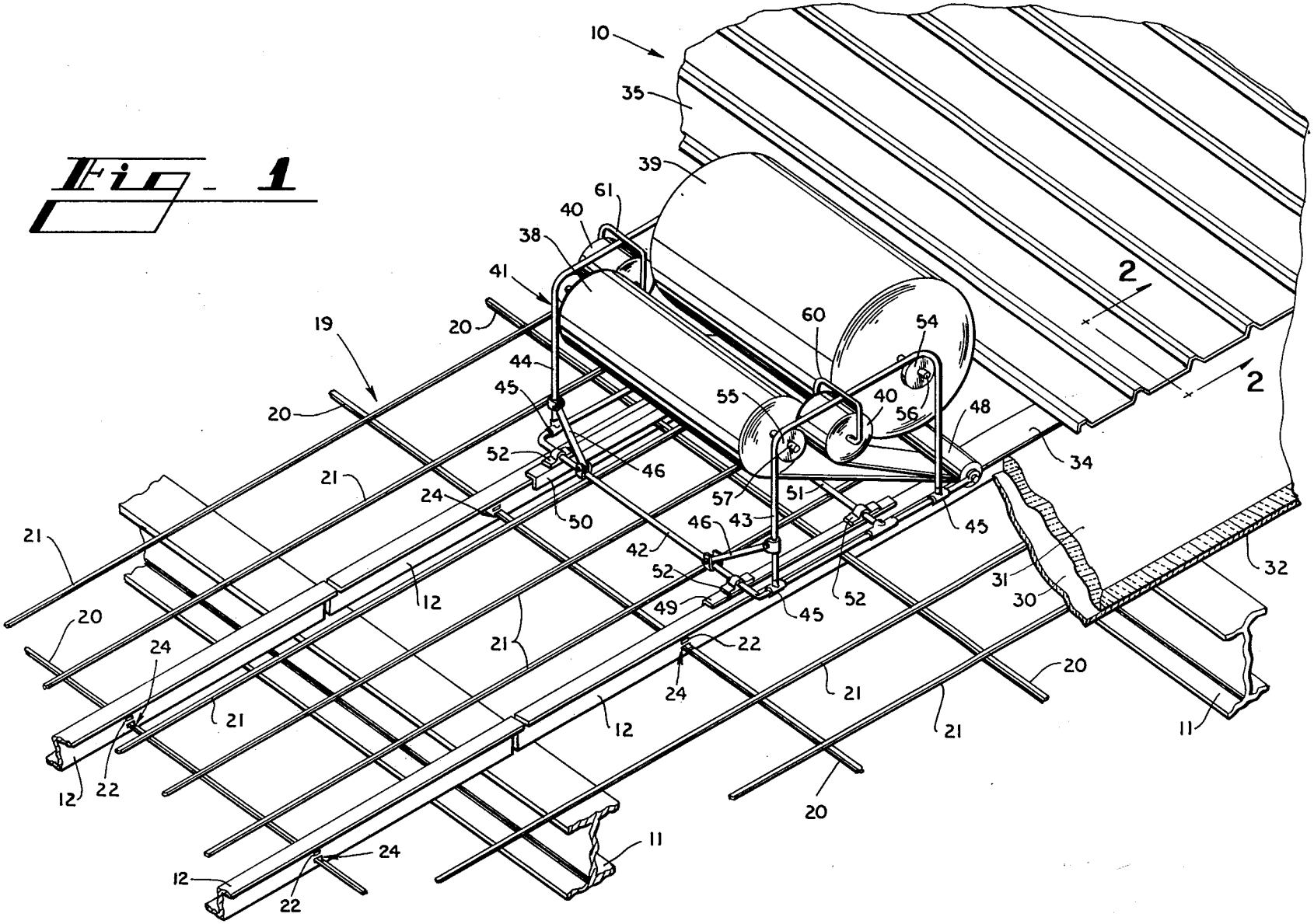
FIG. 1 is a perspective view of a portion of a partially completed roof structure showing the reels of insulation material, the reel support framework for applying the insulation material to the roof structure, the supporting lattice of straps, and showing the manner in which the insulation material is applied to the roof structure.

Referring now in more detail to the drawing, in which like numerals indicate like parts throughout the several views, FIG. 1 shows a partially completed roof structure 10 which includes a plurality of rafters 11 which are positioned parallel to one another and are approximately equally spaced along the length of the building. The rafters 11 are usually inclined and peaked (not shown) at the centerline of the building. A plurality of purlins 12 extend along the length of the building, across the lengths of the rafters. Each purlin 12 usually extends between adjacent ones of the rafters 11, and the purlins are mounted on the rafters. Purlins 12 are approximately Z-shaped (FIG. 3) and include central web 13, upper flange 14 extending in one direction from web 13, and lower flange 15 extending in the opposite direction from web 13. The upper and lower flanges 14 and 15 have their edges 16 and 17 bent further back toward central web 13 to form rims or minor flanges. The configuration of purlin 12 is such that relatively thin light material can be used to fabricate the purlin and the purlin retains enough strength to form adequate support in the roof structure.

In the embodiment illustrated, each purlin 12 is connected at its ends to adjacent ones of the rafters 11, and the purlins 12 are parallel to one another and each purlin extends in a horizontal attitude with its central web 13 extending upwardly.

Figure 3:
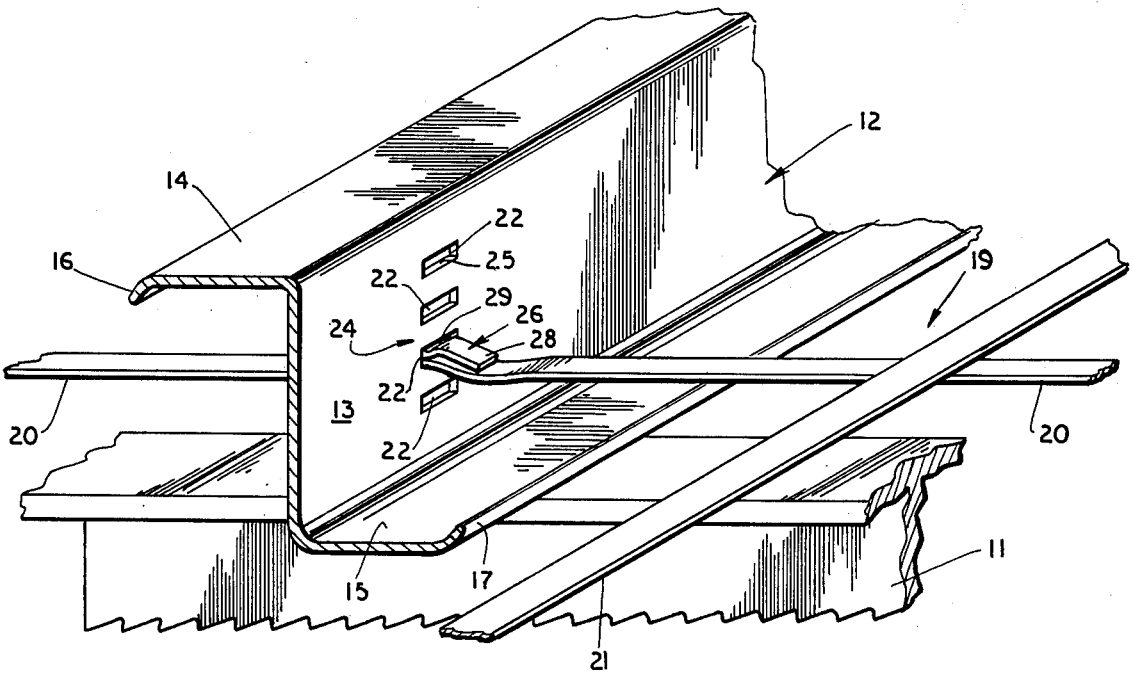
FIG. 3 is a partial perspective view of a rafter, a purlin, the support straps and a fastener.

As is shown in FIG. 1, a lattice 19 of metal straps extends through the central webs 13 of the purlins 12. The lattice 19 includes insulation support straps 20 which extend through the purlins 12 and are located perpendicular to purlins 12 and parallel to the rafters 11. Secondary insulation support straps 21 extend across and rest on support straps 20. As is illustrated in FIG. 3, openings are defined in the central webs 13 of the purlins. The openings 22 are located in groups 24 with the openings 22 being vertically spaced from one another in each group. The groups 24 of openings are located at equally spaced intervals along the length of the purlins as illustrated in FIG. 1. Each opening 22 includes at least one flat surface 25, with the flat surface preferably being located at the bottom of the opening. The insulation support straps 20 extend through one of the openings 22 in a group 24 of openings and engages the flat surface 25 of that opening. A clip 26 is also inserted into the opening through which the strap 20 extends. The clip 26 includes a pair of legs 28 that extend outwardly and are inclined downwardly from a raised central area, and a recess 29 is formed in the raised central area. The clip is usually placed on top of an insulation support strap 20 and moved along the strap into the opening 22 until the recess 29 is positioned in the opening. The downwardly and outwardly diverging legs 28 are shaped and of a size so as to bias or urge the strap 20 downwardly into engagement with the flat surface 25 of the opening, to cause the strap to frictionally engage the opening. When tension is applied to the strap, the portion of the strap extending through the opening tends to engage the flat portion of the opening with more force. Thus, clip 26 functions as a fastener and a means for connecting the strap 20 to the purlins.

Figure 2:
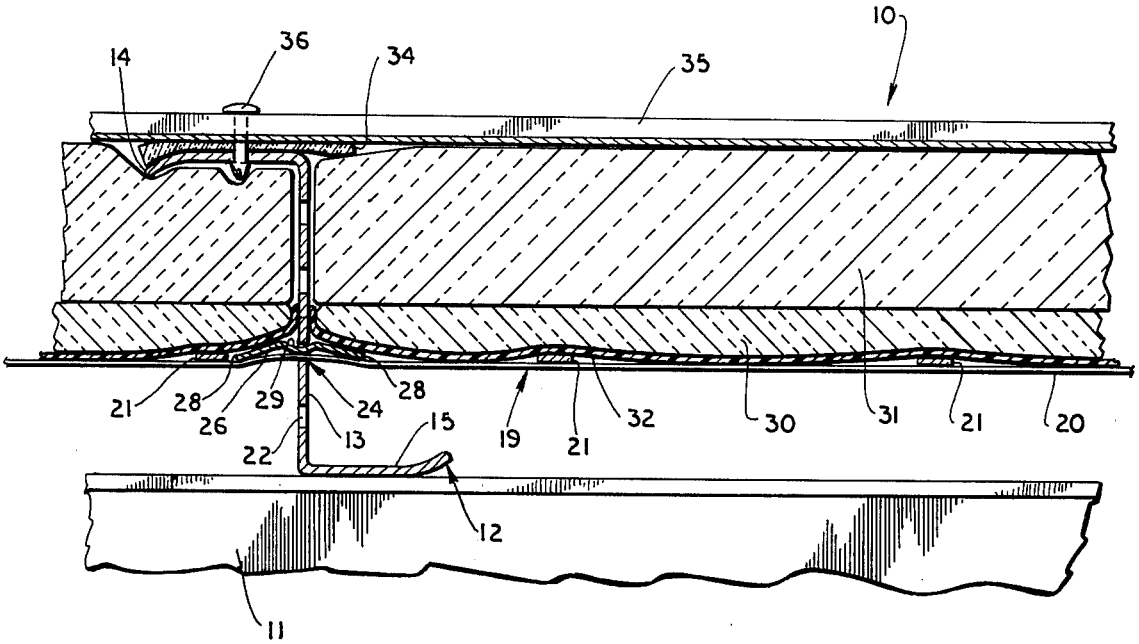
FIG. 2 is a side elevational view of a portion of the completed roof structure.

As is illustrated in FIG. 2, insulation material is placed on the lattice of straps. The insulation material can comprise one or more strips or bats of material, and the thickness of the insulation material can vary. In the embodiment illustrated herein, the insulation material comprises two layers of strips of material, including a lower layer 30 and an upper layer 31. The lower layer 30 includes a layer of vapor impermeable substance such as a vinyl sheet 32 applied to the lower surface of the lower layer which is positioned to contact the lattice 19 of straps. The lower layer 30 is thinner than the upper layer 31, and both layers are of a width sufficient to reach substantially between the central webs 13 of adjacent purlins 12. Additional strips 34 of insulation material are placed on the upper flanges 14 of the purlins. Hard roofing material 35 is placed over the purlins and the strips of insulation material 34 and connected thereto by conventional means, such as by rivets 36. The strips 34 of insulation material function as conduction heat insulators between the hard roofing material 35 and the purlins 12, and the lower and upper layers 30 and 31 of insulation material function as convection and radiation insulators between the hard roofing material and the elements therebelow.

As is illustrated in FIG. 1, the lower and upper strips 30 and 31 of insulation material as well as the purlin insulation material 34 are provided in reels 38, 39 and 40, and a reel support framework 41 is provided for mounting the reels of insulation material on adjacent ones of the purlins 12. Framework 41 comprises a U-shaped base 42, inverted U-shaped sides 43 and 44 connected to the U-shaped base 42 by means of clamps 45, side braces 46, roller 48, guides 49 and 50, and strut 51. Sides 43 and 44 are pivotal with respect to U-shaped base 42 by means of the clamp 45, and the side braces 46 function to releasibly support the sides in an upright attitude or to allow the sides to be folded over and collapsed in an attitude parallel to the U-shaped base for storage and transportation. Guides 49 and 50 are connected to U-shaped base 42 and to strut 51 by means of U-shaped mounting brackets 52, and the brackets 52 allow the guides 49 and 50 to be moved toward or away from each other in situations where the spacing between purlins 12 is not uniform. Guides 49 and 50 are substantially L-shaped in cross section, with each guide including a downwardly extending leg arranged to move between adjacent ones of the purlins and a laterally extending leg arranged to slide on the top surface of the purlins.

The inverted U-shaped sides 43 and 44 each include bearings 54 and 55, and reel support rods 56 and 57 are arranged to extend through the bearings. Roller 48 is freely rotatable and is of a length sufficient to span over the upper surfaces of adjacent ones of the purlins 12. The width of the strips of insulation material is approximately equal to the distance between the central webs 13 of adjacent purlins 12, and the free ends of the reels 38 and 39 extend downwardly from the reels beneath the roller 48. The roller 48 functions to urge the lower and upper strips of insulation material between the adjacent purlins and down into the space defined between the purlins and over the lattice 19 of straps to the positions illustrated in FIG. 1.

Reel brackets 60 and 61 are mounted on the upper portion of inverted U-shaped sides 43 and 44. Reel brackets 60 and 61 are also of inverted U-shaped configuration with the ends of their side legs extending inwardly toward each other. The reels 40 of purlin insulation are mounted in brackets 60 and 61, and the free ends of the strips of insulation from reels 40 are also fed downwardly from the brackets beneath roller 48. The reels 40 are located approximately above the purlins 12 so that the reels will pay out their insulation onto the upper surfaces of the purlin.

When the rafters and purlins have been placed in the roof structure and the roof is ready to receive its insulation and hard roofing material, a lattice 19 of straps 20 and 21 is formed, by extending the insulation material support straps 20 over the rafters 11 and through the openings 22 in the central webs of the purlins 12, and by extending the secondary insulation support straps 21 over the support straps 20. The fasteners 26 are inserted by sliding them through the openings over the straps 20. The straps 20 and 21 are placed under tension, and the fasteners urge the straps 20 down into abutment with the lower flat surfaces of the openings 22 in the central webs 13 of the purlins.

A plurality of the reel support frameworks 41 of the type illustrated in FIG. 1 are mounted on adjacent ones of the purlins 12. The relatively thin lower layers of insulation material 30 are supplied in the forms of reels 38, and the reels 38 are mounted on the framework 40 by extending the support rods 57 through the reels and then extending the support rods through the bearings 55. The relatively thick upper layer 31 of insulation material is supplied in reels 39, and these reels are also mounted on the frameworks 41. The reels of purlin insulation material 40 are hung in their brackets 60 and 61 on each framework.

As the workmen form the roof structure, each framework 41 is pushed out on the purlins 12, by sliding the frameworks on their guides 49 and 50 on the purlins, and the workmen apply the hard roofing material 35 behind the frameworks. As the frameworks are moved along the purlins, the reels 38, 39 and 40 of insulation material pay out into the roof structure. The roller 48 of each framework urges the relatively wide strips from the reels 38 and 39 down between the purlins onto the lattice 19, and the narrow strips from reels 40 at the sides of the framework are urged by the roller 48 onto the upper flanges 14 of the purlins.

Since the relatively thick insulation material is present in reel 39, reel 39 must be replaced on the framework 41 more frequently than the other reels of insulation material. Reel 39 is located closer to the hard roofing material 35 in the normal procedure of applying the material to the roof structure, so that the reel of insulation material that must be replaced most frequently is also the reel which is most convenient to replace. If the thicker layer of insulation is too thick or too stiff to be laid by the reel support framework, it can be inserted between the purlins by hand or by other means after the reel support framework has inserted the thinner layer of insulation in place.

Some roof structures will be formed with relatively thick insulation while others will have much thinner insulation, and in either situation it is desirable to have the insulation material moved up into close abutting relationship with respect to the bottom surface of the hard roofing material. This prevents the circulation of air and vapor adjacent the hard roof material and minimizes problems caused by condensation, corrosion and mildew. The vertical spacing of the openings 22 in the central webs 13 of the purlins allows the lattice 19 of supporting straps to be placed at variable distances from the hard roofing material. For example, FIG. 3 illustrates the support strap lattice 19 as having been installed in the first opening up from the lowest opening. If thinner insulation is to be used, the insulation support straps can be installed in the higher openings, or if thicker insulation material is to be used, the insulation support straps 20 can be installed in the lower openings.

The completed roof structure will have the insulation material located above the lower flange 15 of the purlins so that the lower flange protrudes downwardly and are exposed from the insulation of the roof structure, and the lower flanges 15 are available to accommodate electrical wiring, plumbing and other conventional building items without requiring the insulation to be moved or damaged.

It will be understood by those skilled in the art that the number of layers of insulation material and the type of insulation material can be varied, and although the support straps and secondary support straps have been described as being formed in a lattice which includes a crisscross of straps, the lattice can be formed with only the support straps 20 or by another structural arrangement. Moreover, the configuration of the reel support framework 41 and the fastener 26 can be varied. Generally, while this invention has been described in specific detail with particular reference to preferred embodiments thereof, it will be understood that variations and modifications can be effected within the spirit and scope of the invention as described hereinbefore and as defined in the appended claims.

I claim:

1. In a roof structure comprising a plurality of spaced rafters oriented parallel to one another, a plurality of purlins each including an upwardly extending central web, said purlins being mounted in spaced parallel relationship with respect to one another on said rafters, the improvement therein of the upwardly extending central webs of said purlins defining a plurality of openings at various heights therein with the openings of the purlins being in approximate alignment with the openings of the purlins or opposite sides thereof, and a plurality of insulation support straps oriented parallel to one another and perpendicular to said purlines and extending through aligned ones of said openings of said purlins, elongated strips of insulation material of a width approximately equal to the spacing between the central webs of said purlins positioned between the extending parallel to said purlins and resting on said support straps, and sheets of roofing material mounted on said purlins and extending over said strips of insulation material.

2. The roof structure of claim 1 and further including a plurality of secondary insulation support straps extending across and over said support straps and parallel to said purlins whereby said secondary insulation support straps are supported by said insulation support straps.

3. The roof structure of claim 1 and wherein said elongated strips of insulation material positioned between said purlins comprises a lower layer of insulation material with a bottom surface comprising a vapor impermeable substance, and an upper layer of insulation material of greater thickness than said lower layer resting on said lower layer.

4. In a roof structure comprising a plurality of spaced rafters oriented parallel to one another, a plurality of approximately equally spaced purlins mounted on said rafters and oriented parallel to one another and perpendicular to said rafters, each of said purlins including as upwardly extending central web and at least one laterally extending lower flange, the improvement therein of the upwardly extending central webs of said purlins defining openings therein with at least one flat surface, a plurality of support straps oriented parallel to one another and perpendicular to said purlins and extending through said openings, means for urging said straps into engagement with the flat surface of said openings, elongated strips of insulation material of a width sufficient to substantially span the space between the central webs of adjacent ones of said purlins positioned between and extending parallel to said purlins and resting on said support straps and above the lower flanges of said purlins, and sheets of roofing material mounted on said purlins and extending over said strips of insulation material.

5. In a roof structure comprising a plurality of spaced rafters oriented parallel to one another, a plurality of approximately equally spaced purlins mounted on said rafters and oriented parallel to one another and perpendicular to said rafters, each of said purlins including an upwardly extending central web and laterally extending upper and lower flanges, the improvement therein of each of said purlins defining a series of openings along its length through its central web with the openings of the purlins being in approximate alignment with the openings of the purlins on opposite sides thereof and including at least one flat surface, a plurality of support straps oriented parallel to one another and extending through the openings of the central webs of said purlins, means for urging the support straps into engagement with the flat surfaces of said openings, elongated strips of insulation material of a width sufficient to substantially span the space between the central webs of adjacent ones of said purlins positioned between and extending parallel to said purlins and resting on said support straps and above the lower flanges of said purlins, and sheets of roofing material mounted on said purlins and extending over said strips of insulation material, said strips of insulation material being of a thickness approximately equal to the height of the space between said support straps and said sheets of roofing material and substantially filling the space between said support straps and said sheets of roofing material.

6. In a roof structure comprising a plurality of spaced rafters oriented parallel to one another, a plurality of approximately equally spaced purlins mounted on said rafters and oriented parallel to one another and perpendicular to said rafters, each of said purlins including an upwardly extending central web and at least one laterally extending lower flange, the improvement therein of the upwardly extending central webs of said purlins defining openings therein and a plurality of support straps oriented parallel to one another and perpendicular to said purlins and extending through said openings, fasteners connecting the support straps to the central webs at the openings of said central webs, elongated strips of insulation material of a width sufficient to substantially span the space between the central webs of adjacent ones of said purlins positioned between and extending parallel to said purlins and resting on said support straps and above the lower flanges of said purlins, and sheets of roofing material mounted on said purlins and extending over said strips of insulation material.

7. In a roof structure comprising a plurality of spaced rafters oriented parallel to one another, a plurality of approximately equally spaced purlins mounted on said rafters and oriented parallel to one another and perpendicular to said rafters, each of said purlins including an upwardly extending central web and oppositely laterally extending upper and lower flanges, the improvement therein of each of said purlins defining groups of openings equally spaced along the length of the purlin through its central web with the openings of the purlins being in approximate alignment with the openings of the purlins on opposite sides thereof, a plurality of support straps oriented parallel to one another and extending through an opening of each group of openings of the central webs of said purlins, elongated strips of insulation material of a width sufficient to substantially span the space between the central webs of adjacent ones of said purlins positioned between and extending parallel to said purlins and resting on said support straps and above the lower flanges of said purlins, and sheets of roofing material mounted on said purlins and extending over said strips of insulation material, said strips of insulation material being of a thickness approximately equal to the height of the space between said support straps and said sheets of roofing material and substantially filling the space between said support straps and said sheets of roofing material.

8. In a roof structure comprising a plurality of spaced rafters oriented parallel to one another, a plurality of approximately equally spaced purlins mounted on said rafters and oriented parallel to one another and perpendicular to said rafters, each of said purlins including an upwardly extending central web and laterally extending upper and lower flanges, the improvement therein of each of said purlins defining groups of openings through its central web, said groups of openings being spaced along the length of the purlins with the openings of each group being variably spaced from the flanges of the purlins with the openings of the purlins being in approximate alignment with the openings of the purlins of opposite sides thereof, a plurality of support straps oriented parallel to one another and extending through the openings of the central webs of said purlins, elongated strips of insulation material of a width sufficient to substantially span the space between the central webs of adjacent ones of said purlins positioned between and extending parallel to said purlins and resting on said support straps and above the lower flanges of said purlins, and sheets of roofing material mounted on said purlins and extending over said strips of insulation material, said strips of insulation material being of a thickness approximately equal to the height of the space between said support straps and said sheets of roofing material and substantially filling the space between said support straps and said sheets of roofing material.

9. A method of applying a roof to a building of the type including parallel rafters and a plurality of purlins mounted on and extending across the rafters in a common plane with an upwardly extending central web and upper and lower laterally extending flanges comprising forming a lattice of straps at the level of the central webs of the purlins above the lower flanges of the purlins, supporting reels of elongated insulation material of a width greater than the distance between adjacent ones of the purlins from adjacent ones of the purlins, intermittently moving the reels of insulation along the purlins and paying out the insulation material from the reels and urging the insulation material downwardly between the purlins and into the space between the upwardly extending central webs of the adjacent purlins and onto the lattice of straps between the purlins and above the lower flanges of the purlins with the lengths of the strips extending parallel to the purlins, and applying roofing material to the purlins over the strips of insulation material.

10. A method of applying a roof to a building of the type including inclined parallel rafters and a plurality of purlins with upwardly extending central webs and laterally extending upper and lower flanges mounted on and extending across the rafters comprising extending insulation support means through aligned openings in the central webs of adjacent ones of the purlins at a level between the upper and lower flanges of the purlins, placing elongated strips of insulation material on said insulation support means between the purlins with the lengths of the strips extending parallel to the purlins, and applying roofing material to the purlins over the strips of insulation material.

11. The method of claim 10 and wherein the step of placing elongated strips of insulation material on the insulation support means comprises supporting reels of elongated strips of insulation material on the purlins, and moving the reels along the purlins and paying out the insulation material from the reels down between the purlins as the reels are moved along the purlins.

12. The method of claim 10 and further including the step of placing insulation material on the upper surfaces of the purlins before the roofing material is applied to the purlins.

* * * * *